United States Patent [19]

Haynes

[11] Patent Number: 4,956,612

[45] Date of Patent: Sep. 11, 1990

[54] MAGNETIC MINE FIRING CIRCUIT

[75] Inventor: Robert L. Haynes, Indianapolis, Ind.

[73] Assignee: The United States of America as represented by the Secretary of the Navy, Washington, D.C.

[21] Appl. No.: 602,618

[22] Filed: Jun. 30, 1945

[51] Int. Cl.[5] ..... F42B 22/04

[52] U.S. Cl. ..... 328/5; 102/417

[58] Field of Search ..... 177/351.216, 353; 102/417, 427; 328/5, 78, 80

[56] References Cited

U.S. PATENT DOCUMENTS

| | | | |
|---|---|---|---|
| 2,373,096 | 4/1945 | Bonell | 324/253 |
| 2,383,460 | 8/1945 | Purves et al. | 324/253 |
| 2,384,819 | 9/1945 | Depp | 324/253 |
| 2,400,259 | 5/1946 | Place | 340/825.78 |
| 2,415,654 | 2/1947 | Place | 340/825.78 |

*Primary Examiner*—Stephen C. Bentley

*Attorney, Agent, or Firm*—Michael J. McGowan; Prithvi C. Lall

[57] ABSTRACT

A firing circuit for a magnetic mine including an oscillator and magnetometer bridge is arranged to produce an alternating signal representative of the strength of the ambient magnetic field in the neighborhood of the mine. This signal after rectification and filtering is differentiated to produce a comparatively small direct current signal representative of the rate of change of the surrounding magnetic field. After amplification the signal is in turn applied to a pair of parallel gas tube channels designed to be fired in response to increases and decreases respectively of the signal, and the outputs of the two gas tube channels are retained and combined. A final output circuit is adapted to be fired in response to a predetermined output of the combining network. Since a unidirectional change in field strength will fire only one of the two parallel gas tube channels the circuit becomes responsive to signals of reversed characteristic only, such as may be occasioned by the passage of a ship through the magnetic field of the mine.

5 Claims, 4 Drawing Sheets

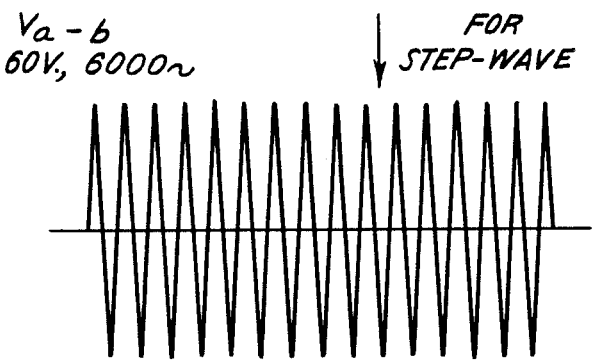
Fig. 7A
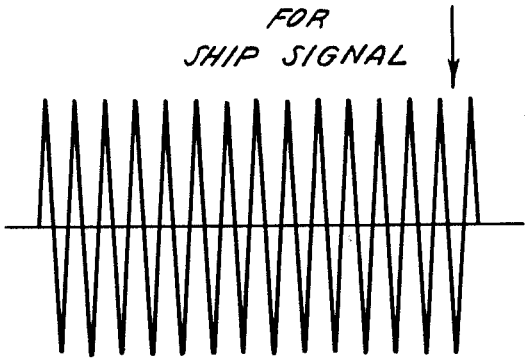
Fig. 7B
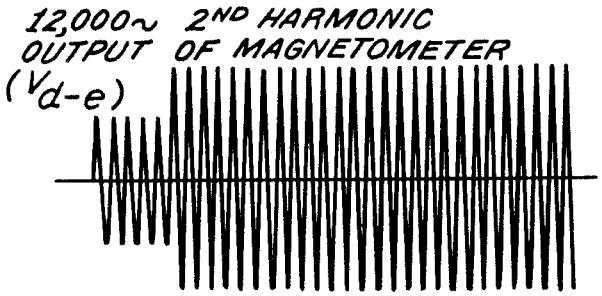
Fig. 8A
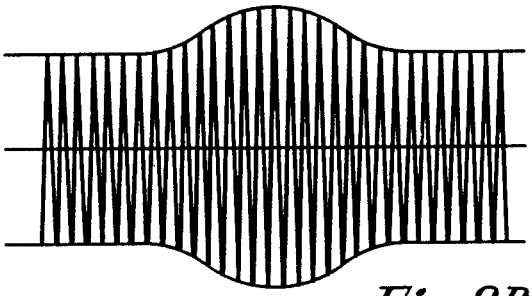
Fig. 8B
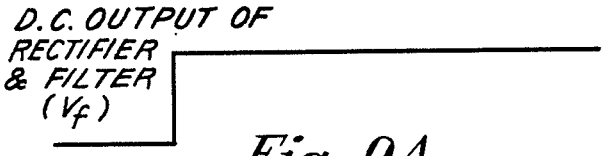
Fig. 9A
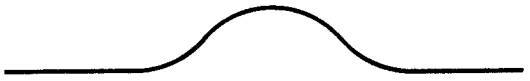
Fig. 9B
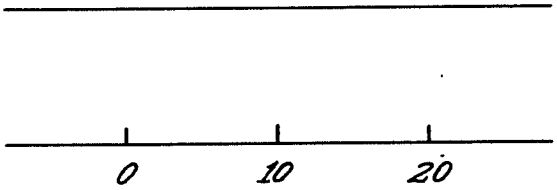
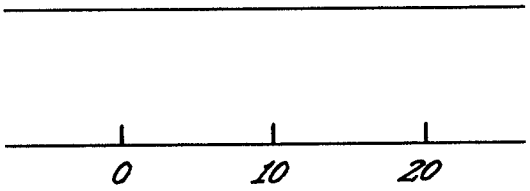

MAGNETIC MINE FIRING CIRCUIT

This invention is concerned with magnetic mines and relates particularly to detector, amplifier and firing circuits for mines of that type.

Magnetic mines generally include a sensitive element, for example, an inductor coil adapted to respond to changes in the strength of the magnetic field surrounding the element. The magnetism due to the earth creates an ambient field which is large by comparison with changes in magnetic field strength caused, for example, by the passing of a ship or other object of magnetic material through the field of the mine. Great sensitivity is therefore required of a mine firing circuit.

The strength of the ambient field is determined in part by the position of the mine with respect to the earth's magnetic axis, and it is difficult, if not impossible, to determine in what position a mine dropped in the water will come to rest on the ocean bottom. In a practical case, the strength of the ambient field may vary between −600 M.G. (milli-gauss) and +600 M.G. while a "ship signal", that is, the change in field strength occasioned by the passing of a ship, may not exceed 3 M.G.

The ambient field determined by the mine coming to rest in a particular position with respect to the earth's magnetic axis, may not remain constant, since waves or other disturbances in the ocean, may alter the position of the mine. Moreover mechanical shock may cause a change in the residual magnetism of the mine case. Changes of this character are in general unidirectional ones and are illustrated in FIG. 5 of the drawings attached hereto. In that figure the field strength is plotted against time, and it will be seen that a step-like unidirectional change occurs from one ambient level to another. By contrast a normal ship signal illustrated in FIG. 4 has a reversed characteristic; and it is therefore necessary so to design a mine firing circuit as to render it unresponsive even to violent unidirectional overloads which may in some cases have an amplitude of 500 M.G., while retaining its sensitivity to ship signals of reversed characteristic.

Heavy pulses of current are required to fire the detonator of a mine. This requirement dictates the use of gas tubes in a mine firing circuit. In some amplifier circuits unidirectional overload may cause surges of output current flowing first in one direction, then in the opposite direction. It is important that the circuit be so designed as not to fire the mine in response to uni-directional over-loading. It is also desirable that the circuit recover quickly and resume its sensitivity within a short period after the occurrence of unidirectional over-loads of the character indicated.

Figure 4:
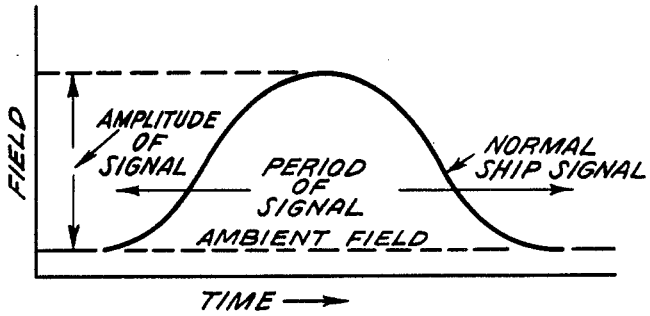
Figure 5:
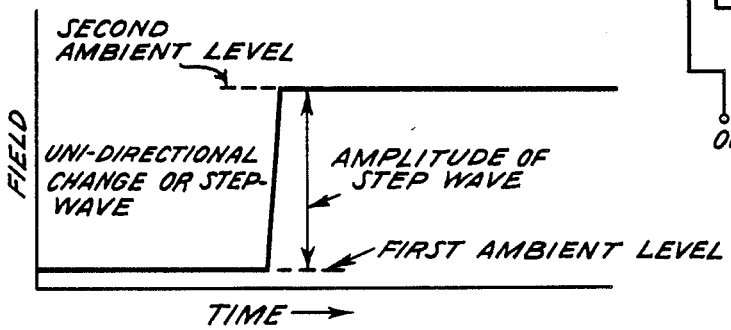

A ship-signal as illustrated in FIG. 4 may vary considerably in period, and a practical mine firing circuit may be required to respond to signals which vary in period from, say, five to 150 seconds.

The requirements of sensitivity and of quick recovery from overload dictate the use of a circuit which must be stable within narrow limits. It will be appreciated that this latter requirement is difficult to satisfy because no adjustments can be made once the mine has been projected in the water.

A prime object of the invention is therefore the provision of an improved detector, amplifier and firing circuit for magnetic mines, said circuit being capable of satisfying the requirements outlined and of providing a practical solution for the problems indicated.

Another object is the provision of a circuit of the character described which is capable of operating with considerable sensitivity and stability in the presence of a large and varying ambient field.

A further object is the provision of a circuit unresponsive to violent unidirectional overloads but sensitive to changes of reversed amplitude with respect to time in the strength of a magnetic field.

An additional object is the provision of a circuit of the character described responsive to signals which may vary in period over a substantial range and capable of recovering quickly from a unidirectional overload.

A further object is the provision of a circuit of the character indicated which is more sensitive and responds more readily to slow magnetic disturbances than circuits previously used for the same purpose, but which does not respond to a unidirectional overload.

An additional object is the provision of a magnetic mine firing circuit having the characteristics outlined, and in which weight, bulk and cost of construction are held to a minimum.

Figure 1:
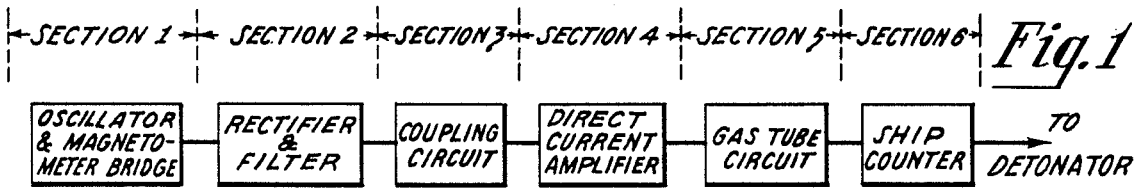
Figure 3:
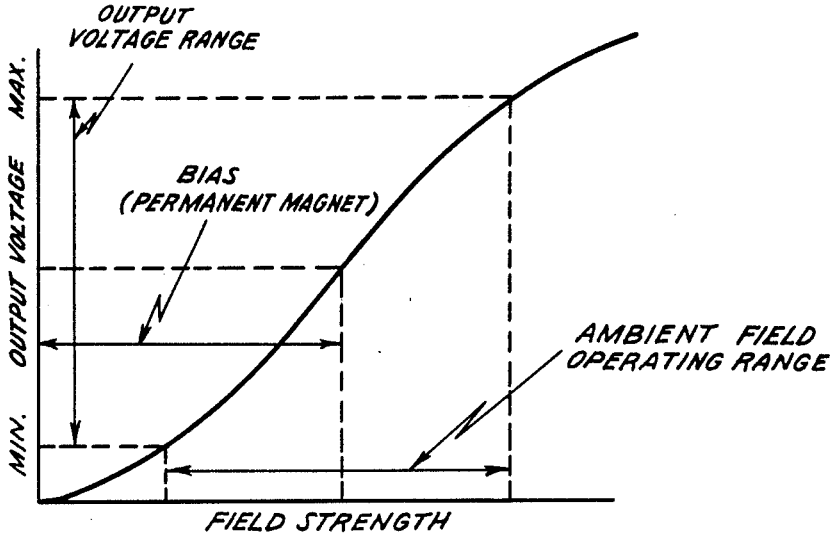
Figure 6:
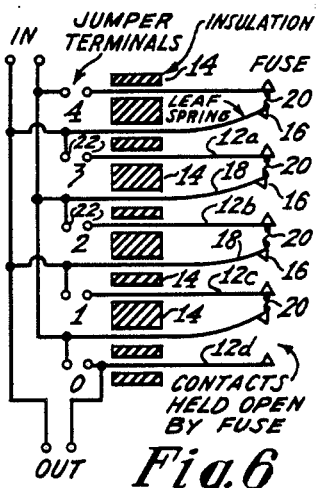
Figure 2:
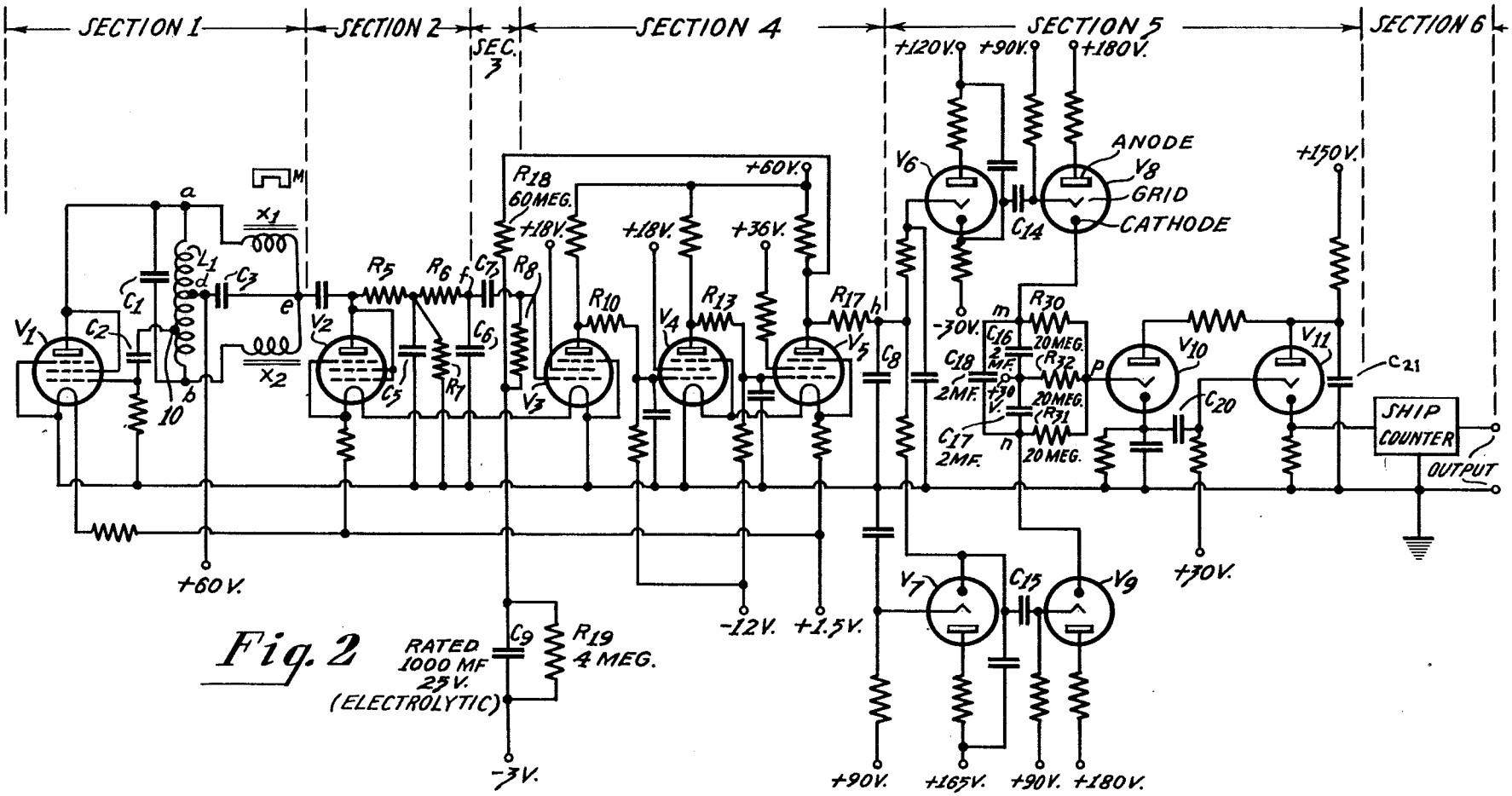

The invention may be better understood from a consideration of the following description of one embodiment thereof when read in conjunction with the accompanying drawings in which FIG. 1 is a block diagram of a circuit according to the invention, FIG. 2 is a schematic diagram of a circuit of FIG. 1, FIG. 3 is a graph illustrating the response of the magnetometer forming part of the circuit of FIGS. 1 and 2, FIG. 4 is a time amplitude curve of a normal ship signal, FIG. 5 is a time amplitude curve illustrating a unidirectional or step-like wave resulting from a change in magnetic field strength ambient level as before explained, FIG. 6 is a circuit diagram of the ship counter of FIG. 1, and FIGS. 7A, 7B to 13A, 13B inclusive are graphs showing the form of signals appearing at different points of the circuit of FIGS. 1 and 2 as hereinafter more fully explained; the figures designated 7A, 8A etc show the form of signals resulting from the application to the circuit of a "step-wave" as hereinbefore defined, while the figures designated 7B, 8B etc. result from the application to the circuit of a ship signal of reversed characteristic.

FIG. 1 is divided into sections to show the different parts of the complete cirucit. Section 1 is an oscillator and magnetometer bridge which provides an alternating signal representative of the strength of the magnetic field surrounding the mine. This signal is rectified and filtered (section 2) and applied to a coupling circuit (section 3) which removes the steady direct current component of the rectified and filtered signal and applies a signal to a direct-current amplifier (section 4) only when the magnetic field strength is changing. For a steady magnetic field of any value the output of the coupling circuit is zero, but when the field is changing the amplifier receives an input signal, which may be no more than a few milli-volts. This input is amplified to a value sufficient to operate the gas tubes of section 5, which will be explained later, and which are connected so as not to respond to unidirectional signals of the character previously outlined.

Section 6 is a ship counter the purpose of which is to make enemy mine sweeping operations slow, costly, dangerous and ineffective. This purpose is achieved by causing the ship counter to fire the mine detonator only after the receipt of a predetermined number of pulses from the gas tube circuit.

The circuit diagram of FIG. 2 is divided into sections to correspond to the marked blocks of FIG. 1. The circuit includes 5 vacuum tubes $V_1$ to $V_5$ inclusive and 6 gas tubes $V_6$ to $V_{11}$ inclusive. Although the vacuum tubes are shown as pentodes, $V_1$ is connected as a triode and $V_2$ as a diode.

The oscillator and magnetometer bridge (section 1 of FIGS. 1 and 2) includes the tube $V_1$ connected as an oscillator with a tank circuit comprising an inductor $L_1$ and capacitor $C_1$ tuned to a frequency of, say 6000 cycles per second. Feedback voltage for the control electrode or grid of the oscillator is provided by a connection including a capacitor $C_2$ from a tap 10 on the inductor $L_1$.

This inductor may be an iron core inductance coil with an air gap and is provided with a center tap d which is "grounded for ac" and gives a balanced output from the oscillator by auto-transformer action. In one embodiment according to the invention the output of the oscillator was 60 volts at a frequency of 6000 cycles per second.

The tap d divides the inductor $L_1$ into two portions which constitute two adjacent arms of a balanced bridge, the other two arms being coils $X_1$ and $X_2$ connected in series with each other across $L_1$. These coils are the sensitive elements of the magnetometer and are arranged side by side and geometrically parallel with each other. Each coil has a thin walled tubular core of "Permalloy" or other highly permeable and sharply saturating material.

The balanced bridge thus constituted has input terminals a,b which are the end terminals of the inductor $L_1$ and output terminals d,e, e being the junction point of the coils $X_1$ and $X_2$. Across these output terminals a capacitor $C_3$ is connected.

The two coils $X_1$ and $X_2$ were previously described as being connected in series with each other across the inductor $L_1$. Regarded however, from either of points d or e, the two coils are connected in parallel with each other, electrically as well as geometrically, and each coil receives the same alternating magnetizing current from the oscillator $V_1$. The voltage at the input to the bridge (across points a and b) is shown in FIGS. 7A and 7B, and is seen to be the same for a step-wave and "ship" signal respectively.

The output of the oscillator is sufficient to produce marked saturation effects in the cores of $X_1$ and $X_2$, and this results in the generation of signals of harmonic frequency. In the absence of a magnetic field odd harmonics only are produced, but a steady magnetic field results in the generation of even harmonics, because current in one direction saturates the cores more easily than does current in the other direction. The capacitor $C_3$ is of such a value as to tune the bridge to one of these even harmonics, preferably the second harmonic frequency of the oscillator. The two coils are connected in such polarity that the second harmonic voltages with respect to ground measured at the right hand terminals of $X_1$ and $X_2$, reach their position maxima at the same instant; their voltages therefore add to each other. The output of the bridge is thus a measure of the strength of the magnetic field surrounding the coils $X_1$ and $X_2$ and hence the mine. The form of this output for a step wave and ship signal is shown in FIGS. 8A and 8B respectively.

It will be observed that the inductor $L_1$ serves at the same time as the tank inductor of the oscillator $V_1$, as a source of feedback voltage for the grid of $V_1$ through the tap 10, as the balanced output element of the oscillator, and as the input arms of the balanced bridge.

FIG. 3 illustrates the variation in the output voltage of the magnetometer bridge with field strength. The characteristic has a substantially linear portion which covers the ambient field operating range from −600 M.G. to +600 M.G. A permanent magnet located near the coils $X_1$ and $X_2$ is provided to bias the magnetometer to about the midpoint of the linear portion of the characteristic. The ambient magnetic field shifts the operating point up and down from this midpoint but the straight portion of the curve is sufficiently long to accommodate any value of background up to 600 M.G. in either direction without serious loss of sensitivity. The magnet provides a simple, reliable and constant means of biasing the magnetometer and consumes no power.

$V_2$ is connected as a diode to rectify the output of the bridge and in this manner gives a substantially linear operation over a wide range. Since it is connected as a shunt rectifier it may be operated from the common filament supply source indicated in FIG. 2.

The rectified signal is applied to a filter consisting of resistors $R_5$, $R_6$ and $R_7$ and capacitors $C_5$ and $C_6$. The output of the filter at point f is almost pure direct current, having a value in one practical embodiment according to the invention of from 5 to 25 volts, depending on the magnitude and direction of the background field. FIGS. 9A and 9B show the form of the rectified output at point f for a step-wave and "ship" signal respectively.

The remainder of the circuit is arranged to respond to comparatively small changes in signal, for example, of the order of 0.02 volts. A differentiating circuit consisting of a capacitor $C_7$ and resistor $R_8$ couples the filter to the succeeding direction current amplifier. $C_7$ and $R_8$ are of such values as to deliver to the amplifier a signal which is a measure of the rate of change of field strength.

The amplifier comprises the three tubes $V_3$, $V_4$ and $V_5$ connected in cascade by direct coupling. Previous circuits for this purpose employed capacitance coupling and recovered in a somewhat complex manner from unidirectional overload. This served to blur the essential differences between ship signals of reversed characteristic and unidirectional signals resulting from changes in ambient level, because each of their two types of signal caused voltage surges in either direction in the output circuit of the amplifier.

The amplifier illustrated, however, has only one R-C circuit ($C_7$-$R_8$) and for this reason recovers from overload in a simple manner. Upon the application to the amplifier of an overloading signal caused by a step wave the output rises or falls suddenly and then returns slowly (with the constants shown, in less than a minute) to its normal value without over shooting.

Figure 10A:
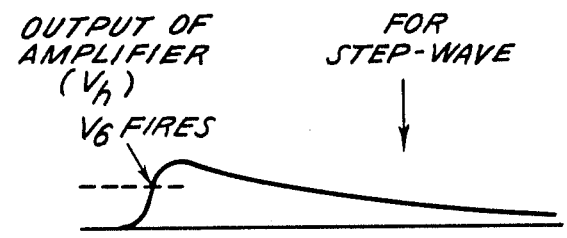
Figure 10B:
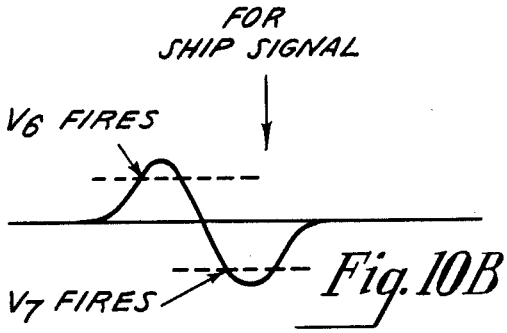

The form of the amplifier output at point h of FIG. 2 for a step-wave and ship signal is shown in FIGS. 10A and 10B respectively.

Two other features of the amplifier may be mentioned at this point. The differentiating circuit $C_7$-$R_8$ has greater sensitivity for fast signals than for slow ones. Accordingly a filter is provided in the amplifier output circuit with elements $R_{17}$-$C_8$ of such value as to discriminate against fast signals and thereby to improve the frequency response. The losses thus created are more than compensated by the gain of the amplifier.

The other feature is the automatic bias adjustment circuit comprising resistors $R_{18}$ and $R_{19}$ and a capacitor $C_9$. A high gain direct-coupled amplifier may sometimes require manual adjustment to "center" the operating point, but such adjustment cannot be made in the device under discussion. Bias for the first stage $V_3$ of the amplifier is provided from a source of negative potential, in the present case −3 volts, through the parallel combination $C_9$-$R_{19}$. The voltage across $C_9$ is 2 volts and the bias applied to the control grid $V_3$ is −1 volt. This condition exists for the normal output of +30 volts, and if the output drifts away from this value, voltage is taken from the output through $R_{18}$ to correct the bias on the first stage. $R_{18}$ has very high resistance and the other elements of the adjusting circuit are chosen of such value that the automatic adjustment is effected very slowly so as not to simulate or otherwise affect even the slowest ship signal likely to be met with in practice.

The gas tube circuit comprises a positive gas tube channel consisting of a pair of gas tubes $V_6$ and $V_8$ connected in cascade, a negative gas tube channel similarly consisting of gas tubes $V_7$ and $V_9$ in cascade, a network consisting of three resistors $R_{30}$, $R_{31}$ and $R_{32}$ connected in star with each other together with associated capacitors $C_{16}$, $C_{17}$ and $C_{18}$ for retaining and combining the outputs of the two gas tube channels, and a third gas tube channel consisting of tubes $V_{10}$, $V_{11}$.

In the embodiment shown each of the 6 gas tubes has three electrodes and is normally un-ionized. The anode cathode potential of each tube is +50 volts and the tube is ignited when its grid has a positive potential of 75 volts with respect to the cathode. Upon ignition the potential drop from anode to cathode is approximately 80 volts, and conduction continues as long as there is sufficient current to maintain the arc in the tube; failing this the tube is extinguished and anode potential rises to 150 volts.

The third gas tube channel is fired only when a sufficient potential is applied to $V_{10}$ from the retaining and combining network. This potential is only attained when both the positive and negative gas tube channels are fired within a predetermined period, thereby preserving the distinction between ship signals of reversed characteristic and unidirectional signals caused by a step-like change in background field strength.

$V_6$, the buffer tube of the positive channel, has a normal grid potential of +60 volts with respect to its cathode. $V_6$ is therefore fired on receipt of a signal of 15 volts or more from the amplifier. The discharge lasts no more than a fraction of a second, but delivers a short positive pulse of about 70 volts to $V_8$ through a capacitor $C_{14}$ connecting the two tubes. This is sufficient to fire $V_8$ and applies a potential of about 70 volts across $C_{16}$ which in turn produces a potential of 35 volts across $R_{32}$.

A similar action occurs when the negative channel $V_7$, $V_9$ is fired resulting in a potential of 35 volts across $R_{32}$.

$V_{10}$ has a normal grid potential of +30 volts and therefore requires a signal of at least 45 volts from the combining network to fire it. A unidirectional change in ambient magnetic field will fire either the positive or negative channel but not both, and this will produce at p, the output of the combining network, a voltage of only 35 volts which is insufficient to fire $V_{10}$.

A ship signal will, however, fire both the positive and negative channels. The retaining and combining network indicated has a time constant of 120 seconds and if the positive and negative channels are fired within 80 seconds of each other sufficient signal is produced at p to fire $V_{10}$.

Figure 11A:
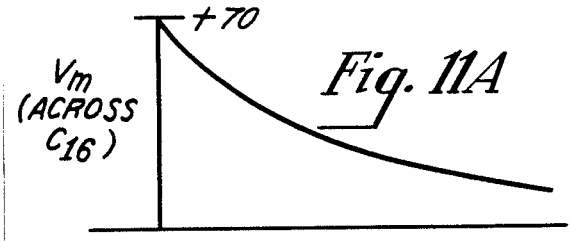
Figure 11B:
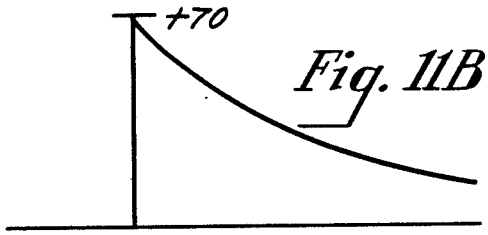
Figure 12A:
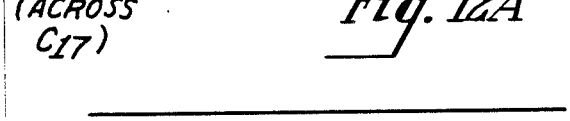
Figure 12B:
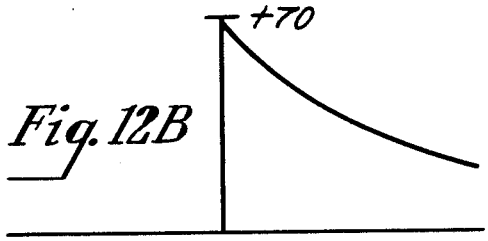

FIGS. 11A and 11B show the form of the signal at point m of FIG. 2—across the capacitor $C_{16}$—caused by a step wave and ship signal respectively. Similarly FIGS. 12A and 12B show the form of the signal at point n—across the capacitor $C_{17}$—for the same two conditions. The step-wave will have caused either pair of gas tubes $V_6$ and $V_8$ or $V_7$ and $V_9$ to fire but not both. By way of example FIG. 11A shows the signal caused by firing of Tube $V_6$ and resulting from a step wave but FIG. 12A does not show any signal, because if the unidirectional step wave caused $V_6$ and $V_8$ to fire it will not also have caused firing of $V_7$ and $V_9$.

Figure 13A:
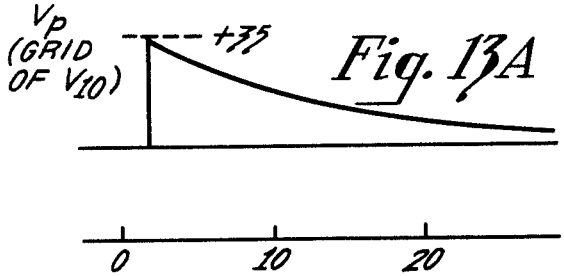
Figure 13B:
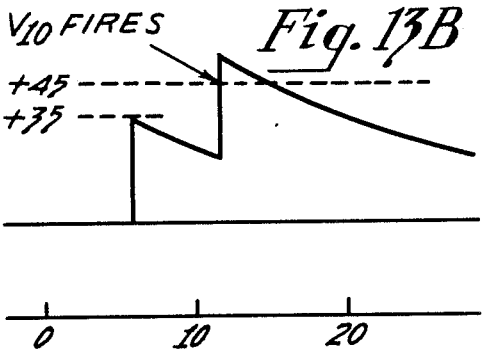

FIGS. 13A and 13B show the form of the signal at point p of FIG. 2—the grid of $V_{10}$—caused by a step wave and ship signal respectively, and it will be observed that the step wave does not provide sufficient voltage to fire $V_{10}$.

A "ship" signal however does fire $V_{10}$ and $V_{11}$ and thereby sends a pulse through a capacitor $C_{20}$ connecting $V_{10}$ and $V_{11}$ and fires the output tube $V_{11}$ which sends a current pulse through a capacitor $C_{21}$ to the ship counter.

For some time after firing of any one of $V_8$ or $V_9$ less than normal bias exists on these tubes. If it were attempted to fire them directly from the amplifier $V_3$- $V_5$, the sensitivity would be reduced during the period of reduced bias. For this reason the buffer tubes $V_6$ and $V_7$ are employed, the buffer tubes resume normal sensitivity immediately after firing and deliver ample signal to fire $V_8$ and $V_9$ in spite of reduced bias. For the same reason the buffer tube $V_{10}$ is employed between the retaining and combining network and the output gas tube $V_{11}$.

The ship counter (FIG. 6) comprises a plurality of circuits **12*a*, 12*b*, etc. connected in parallel across the line from the output tube $V_{11}$ to the mine detonator. Each of the parallel circuits is separated from the circuit adjacent to it by insulating blocks 14. Each circuit includes a pair of contacts 16 held open against the tension of a leaf spring 18 by a fusible link 20 which may be of manganin or constantin wire or other suitable material of high resistance. Each parallel circuit also includes a pair of jumper terminals 22**. Before a mine is projected into water it is determined upon what number of ship signals the detonator of the mine is to be fired and the corresponding pair of jumper terminals is closed by a jumper wire or any other appropriate conductor.

The operation of the ship counter is as follows: Upon the occurrence of the first pulse from the tube $V_{11}$ the link 20 nearest that tube fuses, and the contact 16 formerly restrained by the link is released and brought into conductive engagement with the other contact of the pair under the pressure of the leaf spring 18. The next pulse fuses the next succeeding link, and so on until the last link is fused, whereupon the next pulse fires the detonator. However, since each link and pair of contacts is in parallel with the line each pulse passes through only one pair of contacts. In a practical case it may be desired not to fire the detonator until thirty or more pulses have been received, each representative of a ship signal. If the contacts were in series with the line, substantial resistance might be built up, and the possibility of failure of the device or its improper operation considerably increased. Since the output tube $V_{11}$ may be required to fire more than once, and in a practical case many times, the buffer tube $V_{10}$ is as desirable here as it is in the case of the positive and negative gas tube channels $V_6$-$V_8$ and $V_7$-$V_9$.

There has thus been described a firing circuit for a magnetic mine including an oscillator and magnetometer bridge so arranged as to produce an alternating signal representative of the strength of the ambient magnetic field in the neighborhood of the mine. This signal after rectification and filtering is differentiated so as to produce a comparatively small direct current signal representative of the rate of change of the surrounding magnetic field. After amplification the signal is in turn applied to a pair of parallel gas tube channels designed to be fired in response to increases and decreases respectively of the signal, and the outputs of the two gas tube channels are retained and combined. A final output circuit is adapted to be fired in response to a predetermined output of the combining network. Since a unidirectional change in field strength will fire only one of the two parallel gas tube channels the circuit becomes responsive to signals of reversed characteristic only, such as may be occasioned by the passage of a ship through the magnetic field of the mine.

I claim as my invention:

1. A control device including a circuit for deriving a direct current signal which is a measure of changes in the strength of a magnetic field, a first gas tube channel connected to respond to a change in said signal in one direction a second gas tube channel parallel with the first and connected to respond to a change in said signal in the opposite direction, a network for retaining and combining the outputs of said channels, a third gas tube channel connected to respond to a predetermined value of the output of said network, a pair of gas tubes connected in cascade in each of said three gas tube channels, one tube of each pair forming a buffer for the other tube of said pair, and a utilization circuit forming the output of said third channel.

2. In apparatus required to distinguish between unidirectional changes in a direct current signal and changes in said signal having a reversed time-amplitude characteristic, the combination with an amplifier comprising a plurality of direct coupled amplifying stages, of an input circuit for said amplifier constituted by a resistor-capacitor combination for differentiating said direct current signal and an output circuit capable of distinguishing between positive and negative voltages.

3. A combination according to claim 2 characterized by the addition of a slow-acting automatic bias adjusting circuit for said amplifier, said circuit comprising connections including a resistor-capacitor combination of substantially long time constant for applying bias to a control electrode of the first stage of said amplifier and resistor of substantial value connected to apply voltage of a subsequent stage of said amplifier to said electrode.

4. A combination according to claim 2 characterized by the addition of a filter connected to the output of said amplifier, the values of the elements of said differential combination and of said filter being chosen to respond to different rates of change in said direct current signal.

5. A control device including a circuit for deriving a direct current signal which is a measure of changes in the strength of a magnetic field, a first gas tube channel connected to respond to a change in said signal in one direction, a second gas tube channel parallel with the first and connected to respond to a change in said signal in the opposite direction, a network for retaining and combining the outputs of said channels, a third gas tube channel connected to respond to a predetermined value of the output of said network, a utilization circuit forming the output of said third channel, said network comprising three resistor capacitor combinations connected in star, one of said combinations being connected in the output circuit of said first gas tube channel, another of said combinations being connected in the output of said second gas tube channel, and the values of the elements of said combinations being chosen to fire said third gas tube channel in response to firing of one of either said first or said second channels within a predetermined period after firing of the other of said first or second channels.

* * * * *